US005110266A

United States Patent [19]

Toyoshima et al.

[11] Patent Number: 5,110,266

[45] Date of Patent: May 5, 1992

[54] ELECTRIC BLOWER HAVING IMPROVED RETURN PASSAGE FOR DISCHARGED AIR FLOW

[75] Inventors: Hisanori Toyoshima; Fumio Jyoraku; Yoshitaro Ishii, all of Hitachi; Yukiji Iwase, Ushiku; Shigenori Sato, Niihari, all of Japan

[73] Assignee: Hitachi, Ltd., Tokyo, Japan

[21] Appl. No.: 485,056

[22] Filed: Feb. 26, 1990

[30] Foreign Application Priority Data

Mar. 1, 1989 [JP] Japan ..... 1-046553

[51] Int. Cl.[5] ..... F04B 21/00; F04B 17/00; F04B 35/04

[52] U.S. Cl. ..... 417/312; 417/423.2; 417/423.14; 417/424.1; 417/424.2; 417/312; 417/366

[58] Field of Search ..... 417/423.2, 423.14, 424.1, 417/424.2, 312, 366

[56] References Cited

U.S. PATENT DOCUMENTS 4,767,285 9/1988 Jyoraku ..... 417/366 X

FOREIGN PATENT DOCUMENTS 107100 8/1980 Japan .

*Primary Examiner*—Richard A. Bertsch
*Assistant Examiner*—Alfred Basichas
*Attorney, Agent, or Firm*—Antonelli, Terry, Stout & Kraus

[57] ABSTRACT

An electric blower has an electric motor, a centrifugal impeller rotating by the driving of the electric motor, an end bracket for separating the electric motor from the centrifugal impeller, and a diffuser. The diffuser includes a plurality of diffuser vanes arranged near the outer periphery of the centrifugal impeller, and a flat plate portion which extends between the centrifugal impeller and the end bracket for supporting the diffuser vanes. The flat plate portion has a plurality of guide vanes formed on an opposite surface thereof from the diffuser vanes. A passage is defined by the end bracket, the flat plate portion and the guide vanes so as to return the air flow, discharged from the centrifugal impeller through the diffuser vanes, inwardly of the blower. The end bracket is formed in a substantially convex shape so as to extend away from the flat plate portion of the diffuser, with the end bracket extending from a central portion toward its periphery, thereby defining an opening area of the discharge air flow return passage. A sound absorbing material is arranged in the discharge air flow return passage to absorb sounds from the discharging air flow.

8 Claims, 6 Drawing Sheets

ELECTRIC BLOWER HAVING IMPROVED RETURN PASSAGE FOR DISCHARGED AIR FLOW

BACKGROUND OF THE INVENTION

The present invention relates to an electric blower incorporated, for example, in an electric vaccum cleaner, and in particular, to a noise reducing construction for the electric blower.

Generally, an electric blower of this type includes an impeller directly connected to a rotary shaft of an electric motor for miniaturization and a discharge air flow from the impeller is returned inwardly to cool the electric motor. The devices in which such electric blowers are incorporated are mainly for home use, and it is desirable that noise emitted from these devices minimal.

Therefore, sound absorbing materials have been provided in respective electric blowers so as to reduce noise with the approach being described, for example, in Japanese Utility Model Unexamined Publication No. 61-188000, Japanese Utility Model Unexamined Publication No. 62-16797, and Japanese Patent Unexamined Publication No. 55-107100. The electric blowers described in Japanese Utility Model Unexamined Publication No. 61-188000 and No. 62-16797 respectively have sound absorbing materials which are mounted on a motor frame or an air guide within a return passage for a discharge air flow. The electric blower descried in Japanese Patent Unexamined Publication No. 55-107100 has a sound absorbing material mounted on passage walls of return guide vanes to absorb noises from a discharge air flow passing through the passage.

Further, in the electric blower shown in Japanese Patent Unexamined Publication No. 60-33000, plural openings are formed in portions of a fan casing which face a passage for a discharge air flow in the fan casing, and those openings are covered with a sound absorbing material. When a discharge air flow passes through this passage, parts of the discharge air flows through the openings out of the casing so that the sound absorbing material can absorb noises from the air flowing out of the casing to thereby reduce noise.

Japanese Patent Unexamined Publication No. 62-16798 also discloses an electric blower having a sound absorbing material, wherein a space for absorption of noise is defined between an outer wall of an electric motor and a motor frame and the sound absorbing material is arranged in the space.

U.S. Pat. No. 4,120,616 proposes an electric blower in which a sound absorbing material is installed in an area in which a cooling air for a motor collides so as to reduce generated noise.

An electric blower having a relatively small axial length is also proposed in U.S. Pat. No. 4,757,285.

Considering the use of this type electric blowers as described above, it is desirous for them to have a structure which is compact and low in noise.

SUMMARY OF THE INVENTION

It is an object of the present invention to provide an electric blower which is capable of reducing noise without increasing a size of the electric blower.

Another object of the invention is to provide an electric blower which can produce a sufficient air flow for cooling an electric motor to maximize a service life of the electric blower while having a higher effect of sound absorption as compared with conventional electric blowers.

The present invention has been accomplished on the basis of the results of analysis of conventional structures and is intended to attain the above-mentioned objects by properly forming a return passage for a discharge air flow and disposing a sound absorbing material in this passage.

According to the invention, there is provided an electric blower comprising an electric motor, a centrifugal impeller connected to a rotary shaft of the electric motor for rotation therewith, an end bracket for separating the electric motor from the centrifugal impeller, a diffuser including a flat plate portion extending between the centrifugal impeller and the end bracket, and a plurality of diffuser vanes formed on the flat plate portion close to the outer periphery of the centrifugal impeller. The flat plate portion has a plurality of guide vanes formed on an opposite side surface of the flat plate portion from the diffuser vanes, with a return passage for discharging an air flow being defined by the end bracket, the flat plate portion and the guide vanes to return the discharging air flow from the centrifugal impeller toward the interior of the blower, and with a sound absorber being arranged in the return passage. The end bracket is formed in a substantially convex shape so as to extend away from the flat plate portion of the diffuser. The end bracket extends from a central portion thereof to a periphery thereof, thereby securing an opening area of the return passage.

In the above structure, the end bracket is substantially convex with respect to the flat plate portion of the diffuser. Hence, the discharged air flow return passage defined between them increases in width as the passage extends from the central portion of the blower toward the periphery thereof. Accordingly, the return passage can have a larger opening area to secure sufficient air flow without increasing a structure size of the body as compared with a conventional structure in which an end bracket and the flat plate portion of a diffuser are substantially parallel to each other. Furthermore, the sound absorber is arranged in the discharge air flow return passage so as to achieve a good effect of sound absorption.

BRIEF DESCRIPTION OF THE DRAWINGS

The above and other objects, features and advantages of the present invention, will be apparent from the following detailed description with reference to the accompanying drawings, in which.

DESCRIPTION OF THE PREFERRED EMBODIMENTS

Figure 1:
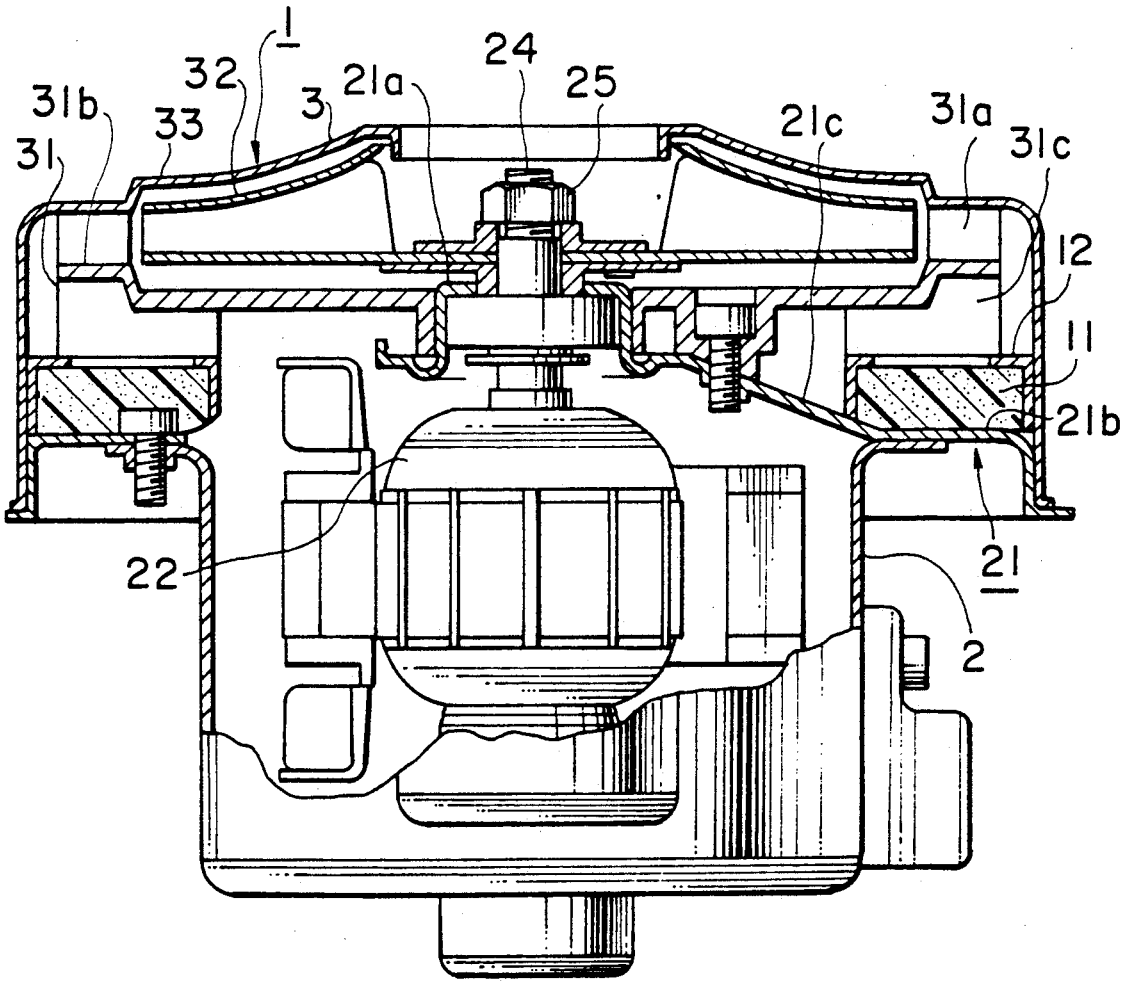
FIG. 1 is a cross-sectional view showing the electric blower according to an embodiment of the invention.

In conventional electric blowers described above, no consideration is given to both miniaturization of the blower and noise reduction without sacrificing performance of the blower line. More particularly, when the sound absorbing material is arranged in the discharge air flow return passage, a good sound absorption can be expected, because the sound absorbing material directly contacts the discharging air flow. However, the aerodynamic performance of the blower is affected due to the narrowing of the passage resulting from the provision of the sound absorbing material. As a solution for this problem, the opening area of the passage may be enlarged by increasing the distance between the members defining the passage; however, if the members are simply separated in an axial direction from each other the size of the blower as a whole is increased.

Another problem arises when the sound absorbing material is arranged adjacent to the return passage for discharge air flow as proposed, for example, Japanese Patent Unexamined Publication No. 60-33000. More particularly, to cover the outer periphery of the side wall of the fan casing with the sound absorbing material results in laterally enlarging the electric blower by the thickness of the sound absorbing material. In addition, since parts of the discharging air flow are released outside the fan casing from the opening in the side wall thereof as the discharging air passes through the return passage, the amount of air flowing into the electric motor decreases. There is a possibility, therefore, that the motor can not be sufficiently cooled and the service life of the electric blower may be shortened. Furthermore, since only portions of the discharging air flow contact with the sound absorbing material on the side wall of the fan casing, a sufficient sound absorption is not realized.

Therefore, the sound absorbing material be arranged in the return passage for discharge air flow, in order to obtain a sufficient sound absorption. Furthermore, for decreasing the influence on the aerodynamic performance due to the sound absorbing material being arranged in the return passage, it is important that the return passage provides at least a sufficient opening area for the discharging air flow.

In order to accommodate the increase in size of the opening are without increasing the overall size of the electric blower, it is essential for achieving both noise reduction and miniaturization to arrive at a solution which does not require an increase in size of the electric blower.

It has been experimentally determined that the opening area of the passage can be secured by forming the end bracket in a convex shape. Such formation is unique since conventionally, end brackets are substantially flat and, such formation is unexpected in view of a common design approach which usually aims at a simplification of structural elements. However, the convex shape is remarkably effective in achieving not only the noise reduction but also enables a miniaturization of the entire blower assembly.

More particularly, by virtue of the above formation, the return passage for discharge air flow has a large opening area, and the sound absorbing material can be arranged within the return passage. Therefore, it is possible to avoid laterally increasing a size of the blower as with the electric blower in Japanese Patent Unexamined Publication No. 60-33000. The end bracket thus formed also increases in an axial height due to the shape. However, it is possible to contain or receive the outer peripheral portion of the convex-shaped bracket by utilizing a space within the blower to prevent the shaped bracket from affecting a total height of the electric blower.

By virtue of the arrangement of the sound absorbing material in the return passage for discharge air flow, it is unnecessary to provide an opening for the sound absorbing material which is disposed at the outside of the passage as in the electric blower in Japanese Patent Unexamined Publication No. 60-33000. In addition, the return passage has a sufficient opening area even after the sound absorbing material has been arranged therein. Therefore, it is possible to secure a sufficient air flow so as to prevent insufficient cooling of the electric motor due to reduction of an inflow of air, thereby preventing the working life of the electric blower from shortening.

Further the sound absorbing material arranged in the discharge air flow return passage can sufficiently contact the discharge air flow from the diffuser to exhibit a good sound absorption. The sound absorbing material is arranged near the noise sources of the electric blower, that is, sound generated from vanes of the centrifugal impeller and the diffuser, whirling sound generated at the time when the discharging air flow is changed in its flow direction; therefore, noises can be significantly absorbed before diffusion.

Referring now to the drawings wherein like reference numerals are used throughout the various views to designate like parts and, more particularly, to FIG. 1, according to this figure, an electric blower generally designated by the reference numeral 1 is divided into an electric motor section and a blower section 3, with an end bracket 21 being mounted on a side of the motor section 2. The end bracket 21 includes a bearing holder portion 21*a* positioned at the central portion to hold a bearing 23 for a rotor 22, an annular flat portion 21*b* at a periphery thereof, and a support arm 21*c* for interconnecting the holder portion 21*a* and the flat portion 21*b*.

Figure 2:
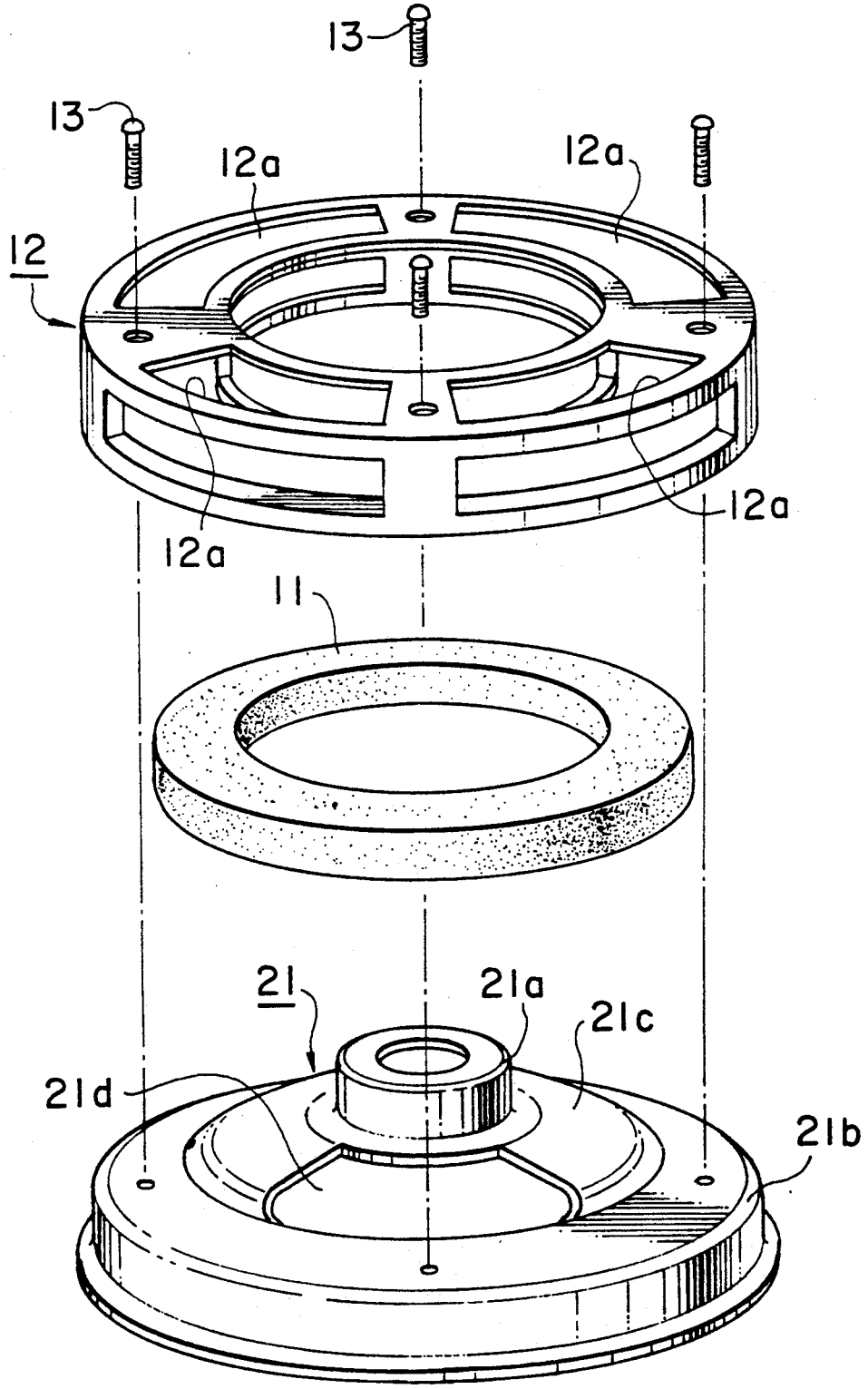
FIG. 2 is a exploded perspective view of a frame, a sound absorber and an end bracket provided in the embodiment of FIG. 1.

As shown in FIG. 2, openings 21*d* are formed in the support arm portion 21*c* for allowing discharging air flow from the blower section 3 to flow into the motor section 2. The support arm 21*c* is formed in a convex shape such that the support arm 21*c* extends away from a return passage for the discharging air flow and, shown in FIG. 1, the support arm portion 21*c* extends from a central portion of the end bracket 21 toward the periphery thereof.

A diffuser 31 is arranged on the end bracket 21. Above the diffuser 31, a centrifugal impeller 32 is fixed by a nut 25 to a rotary shaft 24 of the rotor 22 for rotation therewith.

A fan casing 33 is press-fitted onto the periphery of the end bracket 21 to be fixed thereto in such a manner that the fan casing covers the centrifugal impeller 32 and the diffuser 31.

The diffuser 31 has a flat plate 31*b* which is positioned on the peripheral side of the centrifugal impeller 32. Diffuser vanes 31*a* are formed on the upper surface of the flat plate 31*b*. Further guide vanes 31*c* for returning a flow of discharged air are formed on the lower surface of the flat plate 31*b*. The guide vanes 31*c* cooperate with the end bracket 21 to form a return passage for the discharge air flow which passage leads the discharge air flow to the openings 21*d* shown in FIG. 2. A frame 12 in which a sound absorbing 5 material 11 is contained is disposed on the annular flat portion 21*b* of the end bracket 21.

As shown in FIG. 2, the frame 12 is integrally secured to the end bracket 21 with screws 13, and has cutouts 12*a* formed in a face which is opposite to and abuts against the guide vanes 31*c* shown FIG. 1. Thus, the sound absorbing material 11 within the frame 12 is exposed at the portions of the frame 12 facing the discharge air flow return passage.

The sound absorbing material 11 is flexible and is generally composed of such a porous material as a sponge, MOLTPREN (Trade name, Nishiyama Rubber Co.). Such material is hard to handle and, it is difficult to automate the assembly of such material; therefore, inevitably, the assembly has to be carried out manually. When the sound absorbing material 11 is housed in the frame 12, however, it becomes easy to handle the material, and it becomes possible to automate the assembly.

In the construction described above, air is suctioned through a central opening of the fan casing 33 by the centrifugal impeller 32, flows from the inner periphery of the impeller to the outer periphery thereof, and is discharged to the peripheral side. Succeedingly, the air current recovers its static pressure at the diffuser vanes 31*a*. The air current changes flow direction at the outer periphery of the diffuser, and flows back through the return passage from the outer periphery toward the central portion of the diffuser 31. At this time, the air current contains the sound emitted by the centrifugal impeller 32 and the diffuser vanes 31*a*, the whirling sound generated at the time when the direction of the discharge air flow is charged, and so on . These noises, when the air flows through the return passage, are absorbed by the sound absorbing material 11 arranged near the sound sources, that is, the sound absorbing material 11 which faces to the discharge air flow return passage, and therefore, a good noise reduction can be obtained.

Figure 5:
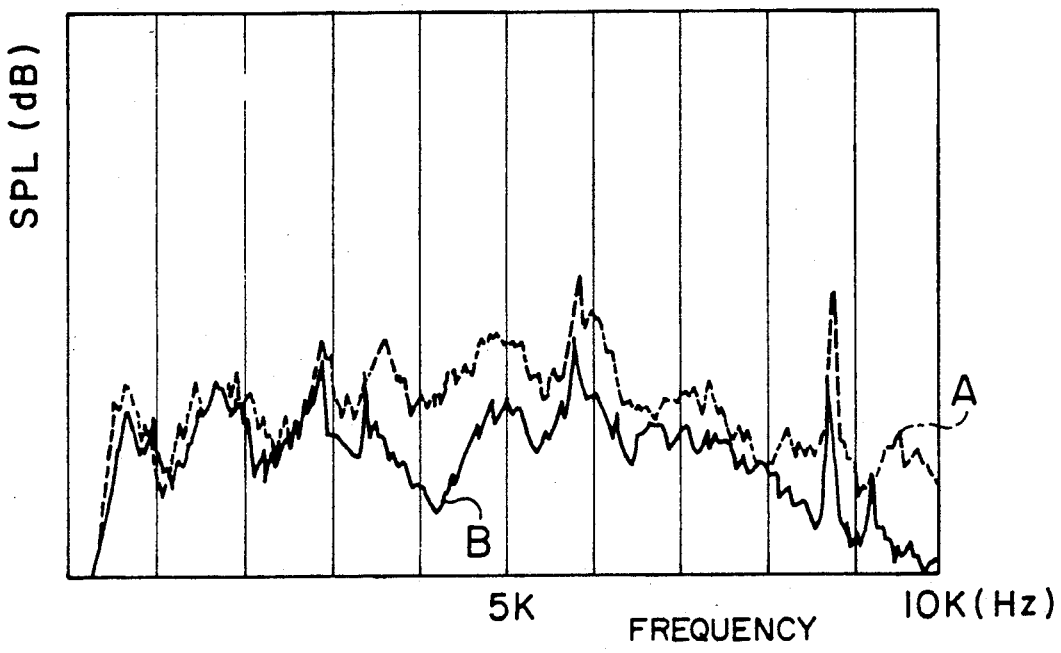
FIG. 5 is a graphical illustration of a characteristic curve of the noise frequency of the electric blower according to the invention in comparison with a conventional electric blower.

FIG. 5 is a comparative diagram of the frequency characteristic of the noise of an electric blower which has been manufactured by way of according to the invention, and that in a conventional electric blower. In FIG. 5, a broken line a represents the analytic result of the frequency of the noise emitted from the conventional electric blower, while a solid line B represents that of the electric blower according to the invention. According to the invention, the effect of noise reduction is remarkable, particularly, in the high frequency region over 4 KHz, though the effect varies depending upon the sound absorption characteristics of the sound absorbing material, in which region noise can be reduced by 4 to 5 dB at overall values. Besides, usually, it is difficult to reduce noise in the low frequency region under 3 KHz only by the provision of a sound absorbing material, because the noise is appreciably affected by components of rotational vibration, etc. However, according to the invention, with the help of the rigidity of the frame structure 12 containing the sound absorbing material 11, it is possible to reduce the noise by improving the rigidity of the electric blower 1 so as to shift the natural frequency thereof into a higher frequency region or by utilizing the resonance effect and so on.

As evident from the description of the invention, the sound absorbing material 11 is arranged in the discharge air flow return passage which is defined by the discharge air flow guide vanes 31*c* formed on the lower surface of the diffuser 31 and the end bracket 21 of the electric motor. Accordingly, it is possible to eliminate the disadvantage which is caused by covering the periphery of the side wall of the fan casing with sound absorbing material as in Japanese Patent Unexamined Publication No. 60-33000, that is to say, the disadvantage that the electric blower is laterally increased by the thickness of the sound absorbing material.

Moreover, according to the invention, it is not necessary to form openings for passage of a discharge air flow in the side wall of the fan casing as in Japanese Patent Unexamined Publication No. 60-33000. Therefore, no discharge air flow is released in the middle of the passage, because of no opening is formed in the surface of the side wall of the fan casing facing the discharge air flow passage. Consequently, it is also possible to solve the problem that the air flowing in the electric motor decreases in amount so that the motor may be inefficiently cooled to result in shortening the working life of the electric blower.

In addition, according to the invention, since the sound absorbing material 11 arranged in the discharge air flow return passage sufficiently contacts the discharging air flow, the effect of sound absorption can be remarkably improved as compared with the electric blower described in Japanese Patent Unexamined Publication No. 60-33000, wherein the discharging air flow contacts the sound absorbing material only outside the discharge air flow passage, or only outside the openings formed in the side wall of the fan casing. In the invention, the sound absorbing material 11 is arranged in the discharge air flow return passage which is positioned near the sources of noise of the electric blower, that is, the sounds emitted by the centrifugal impeller 32 and the diffuser vanes 31*a*, the whirling sound generated at the time when the direction of the discharging air flow is changed, and so on. Therefore, it is possible to absorb the sounds before the noise is significantly diffused in the circumference. Thus, the effect is remarkable, which is achieved by arranging the sound absorbing material 11 in the return passage for discharged air flow.

Figure 3:
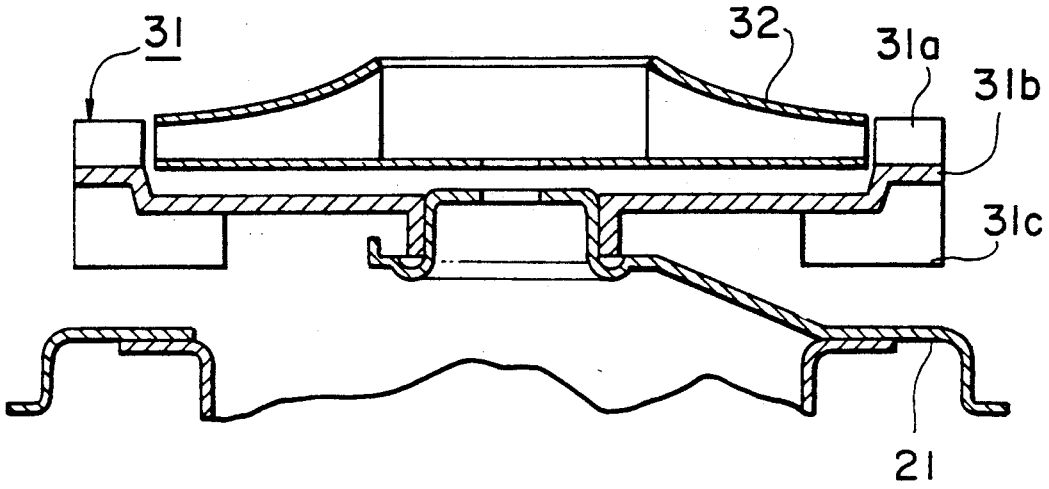
FIG. 3 is a cross-sectional view showing the relation between a centrifugal impeller, a diffuser and the end bracket in the embodiment of FIG. 1.
Figure 4:
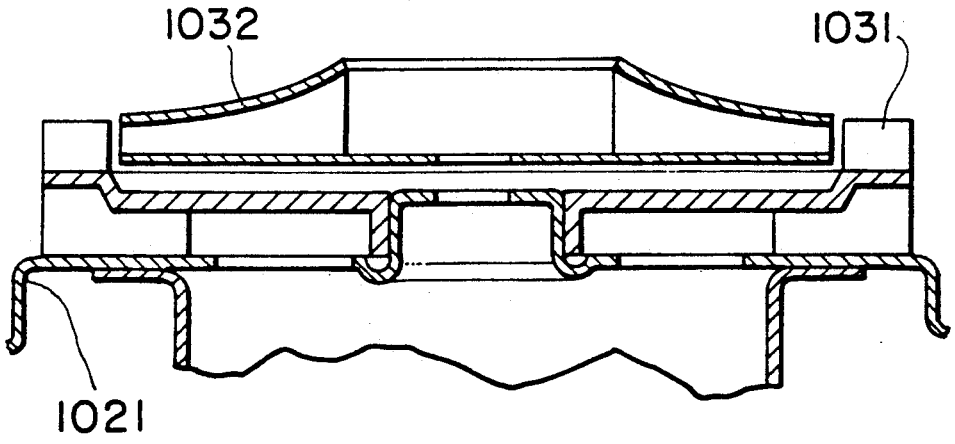
FIG. 4 PRIOR ART
FIG. 4 is a cross-sectional view showing the relation between a centrifugal impeller, a diffuser and an end bracket in a conventional electric blower.

FIG. 3 shows the centrifugal impeller 32, the diffuser 31 and the end bracket 21 shown in FIG. 1 by omitting the other elements. On the other hand, FIG. 4 shows a centrifugal impeller 1032, a diffuser 1031 and an end bracket 1021 of a conventional electric blower, by omitting the other elements, for comparison with FIG. 3.

As shown in FIGS. 1 to 3, the support arm portion 21*c*, connecting the bearing holder portion 21*a* and the annular flat portion 21*b* of the electric motor end bracket 21 with each other, is formed in a convex shape so as to extend away or become remote from the discharge air flow passage, or as shown in FIG. 1, the arm portion 21*c* extends from the central portion toward the periphery of the end bracket. Therefore, the cross-sectional area of the discharge air flow return passage, defined by the guide vanes 31c of the diffuser 31 and the end bracket 21, can be made large as compared with the conventional electric blower shown in FIG. 4. Thus, it is possible to furthermore enhance the aerodynamic performance of the electric blower while making the effect of noise reduction more effective. When the support arm portion 21c of the end bracket 21 of the electric motor is formed in the convex shape as described above, the axial height of the end bracket 21 itself becomes larger than that of the conventional end bracket shown in FIG. 4. However, this increment of the height does not increase, to any degree, the size of the electric blower in the longitudinal direction thereof as a whole, because the increment of the height can be regarded as being eliminated by effectively utilizing the space within the fan casing 33.

In the embodiment of FIGS. 1-3, the sound absorbing material 11 has been arranged on the annular flat portion 21b of the end bracket 21 of the electric motor. However, in the embodiment shown in FIGS. 6 and 7, the sound absorbing material 111 is arranged on the rear side of the flat plate 31b which constitutes a part of the diffuser 31. Also in the embodiment of FIG. 6, the sound absorbing material 111 is arranged in the discharge air flow return passage of the electric blower.

Figure 8:
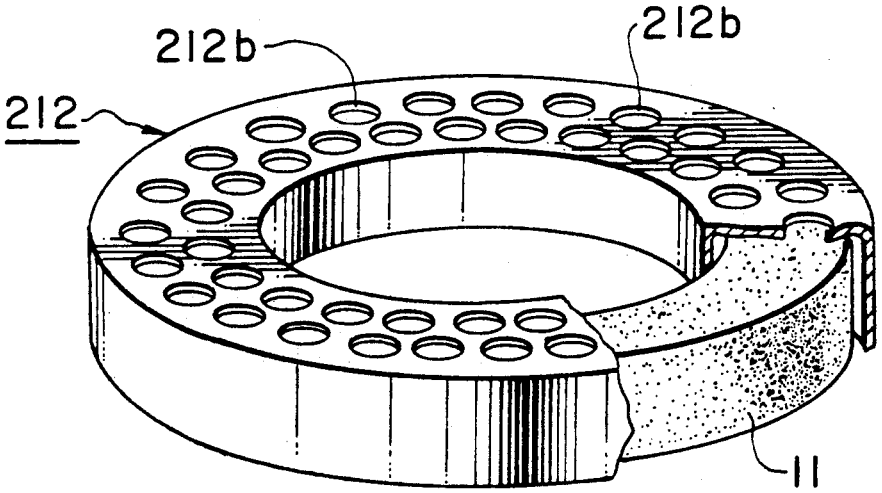
FIG. 8 is a partially broken away perspective view showing a frame and a sound absorber of the electric blower according to still another embodiment of the invention.

FIG. 8 shows a frame 212 and the sound absorbing material 11 of the electric blower according to the third embodiment of the invention. In this embodiment, a large number of small holes 212b are perforated in a surface of the frame 212 on the side thereof facing the discharge air flow return passage, in which frame the sound absorbing material 11 is contained, as a modification of the first embodiment of FIGS. 1-3. According to the embodiment of FIG. 8, in addition to the effect which is common to the first and second embodiments, it is possible to furthermore enhance rigidity of the frame 212 by forming therein a large number of small holes 212b instead of the cutouts 12a in the first embodiment.

Figure 9:
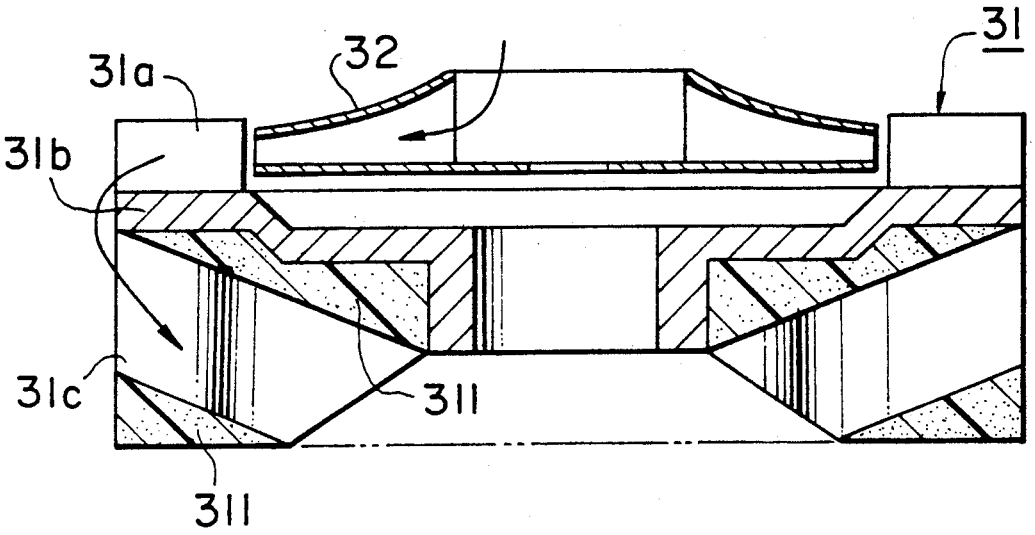
FIG. 9 is a cross-sectional view showing the mounting relation of a centrifugal impeller, a diffuser and a sound absorber of the electric blower according to a still further embodiment of the invention.
Figure 10:
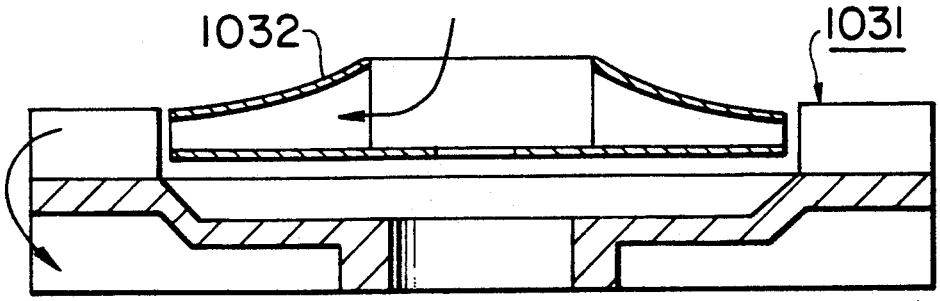
FIG. 10 PRIOR ART
FIG. 10 is a cross-sectional view showing the relation of a centrifugal impeller, a diffuser and a sound absorber in a conventional electric blower for comparing the same with the relation shown in FIG. 9.

FIG. 9 shows the assembled construction of the centrifugal impeller 32, the diffuser 31 and a sound absorbing material 311 in the electric blower according to the fourth embodiment of the invention. FIG. 10 is a longitudinal section of the centrifugal impeller 1032 and the diffuser 1031 of the conventional electric blower by omitting the other elements for comparison with FIG. 9.

Figure 6:
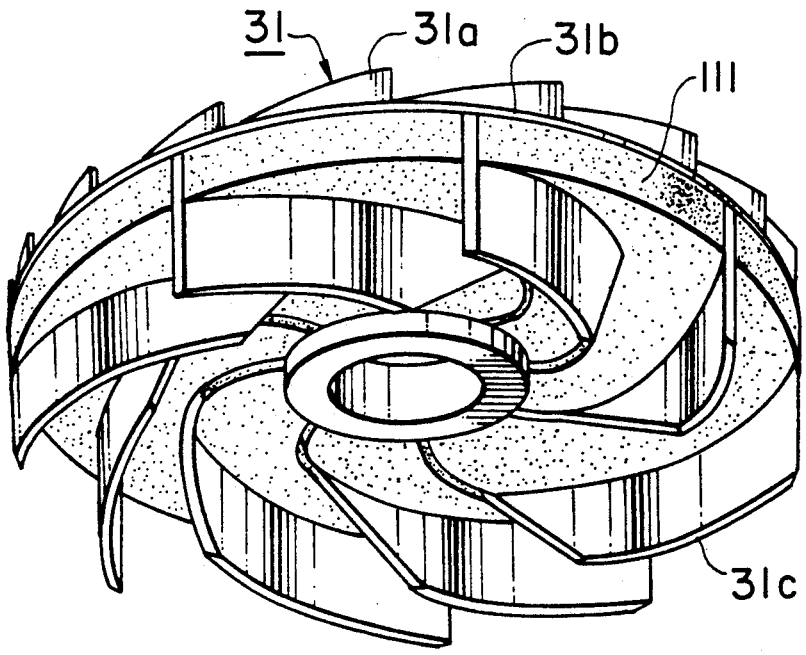
FIG. 6 is a perspective view showing a diffuser and a sound absorber of the electric blower according to another embodiment of the invention.
Figure 7:
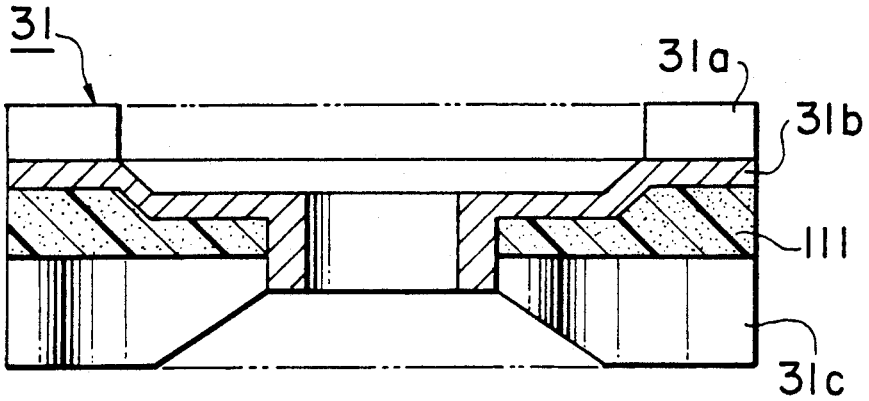
FIG. 7 is a cross-sectional view showing the diffuser and the sound absorber shown in FIG. 6.

In the second embodiment shown in FIGS. 6 and 7, the sound absorbing material 111 is arranged on the rear side of the flat plate 31b which constitutes a part of the diffuser 31. In the fourth embodiment shown in FIG. 9, however, the sound absorbing material 311 is arranged on the surfaces of the discharge air flow guide vanes 31 which constitute another part of the diffuser 31, and is inclined toward the directions of the openings, see the openings 21d shown in FIG. 2, of the end bracket (see the end bracket 21 shown in FIG. 1). According to this embodiment it is possible to allow the air current discharged from the diffuser vanes 31a to change the direction of flow smoothly into the return passage, as shown by an arrow in FIG. 9, as compared to the conventional electric blower shown in FIG. 10. Accordingly, an aerodynamic loss of the air current can be decreased, thereby maximizing noise reduction which noise accompanies the aerodynamic loss.

Although the invention has been described that the sound absorbing material is arranged in the discharge air flow return passage, it should be noted that an effect of sound absorption can be expected to a certain extent only by sufficiently increasing the opening area of the discharge air flow return passage by means of the end bracket of the convex shape.

As described above, according to the invention, it is possible to, without increasing the size of the electric blower, to avoid or disadvantage of decreasing the amount the air flowing into the electric motor and thereby insufficiently cooling of the motor resulting in a reduction in the service life of the electric blower. Further, the invention can provide the improved electric blower which is capable of enhancing the sound absorption thereof as compared with the conventional electric blower.

The invention has been described on the basis of the preferred embodiments. However, it should be understood that the invention is not limited solely to the specific forms of these embodiments, and that various modifications can be made or the invention can take other forms without departing from the scope of the attached claims.

What is claimed is:

1. An electric blower comprising:

an electric motor;

a centrifugal impeller connected to a rotary shaft of said electric motor for rotation therewith;

end bracket means for separating said electric motor from said centrifugal impeller;

a diffuser including a flat plate portion extending between said centrifugal impeller and said end bracket means and a plurality of diffuser vanes formed on said flat plate portion near an outer periphery of said centrifugal impeller, said flat plate portion having a plurality of guide vanes formed on a surface of said flat plate portion opposite said diffuser vanes;

a discharge air flow return passage defined by said end bracket means, said flat plate portion and said guide vanes for returning a discharging air flow from said centrifugal impeller inwardly of said blower;

said end bracket means has a substantially convex shape so as to extend gradually away from said flat plate portion of said diffuser as said end bracket means extends from a central area thereof toward an outer periphery thereof and terminate in an annular flat plate portion disposed substantially parallel to said flat plate portion of said diffuser, thereby defining an opening area of said discharge air flow return passage; and a sound absorbing material arranged in said discharge air flow return passage and disposed on said annular flat plate portion of said end bracket means.

2. The electric blower according to claim 1, wherein said electric blower includes a case and a rotor housed in said case, said end bracket means includes a central portion for holding a bearing of said rotor, and a support portion for interconnecting said central portion and said annular flat portion with each other, and said support portion has at least one through hole formed therein for allowing the discharge air flow to flow through said case of said electric motor.

3. The electric blower according to claim 1, wherein said sound absorbing material is received in at least one frame and is attached through said frame in said discharge air flow return passage.

4. The electric blower according to claim 3, wherein said frame is formed in a shape of an annulus.

5. The electric blower according to claim 4, wherein an opening extending in a longitudinal direction of said frame is formed on a side of said frame facing said discharge air flow return passage.

6. The electric blower according to claim 4, wherein said frame includes a plurality of small holes formed in said frame facing said discharge air flow return passage.

7. An electric blower comprising:

an electric motor;

a centrifugal impeller connected to a rotary shaft of said electric motor for rotation therewith;

end bracket means for separating said electric motor from said centrifugal impeller;

a diffuser including a flat plate portion extending between said centrifugal impeller and said end bracket means and a plurality of diffuser vanes formed on said flat plate portion near an outer periphery of said centrifugal impeller, said flat plate portion having a plurality of guide vanes formed on a surface of said flat plate portion opposite said diffuser vanes;

a discharge air flow return passage defined by said end bracket means, said flat plate portion and said guide vanes for returning a discharging air flow from said centrifugal impeller inwardly of said blower;

said end bracket means has a substantially convex shape so as to extend gradually away from said flat plate portion of said diffuser as said end bracket means extends from a central area thereof toward an outer periphery thereof and terminate in an annular flat plate portion disposed substantially parallel to said flat plate portion of said diffuser, thereby defining an opening area of said discharge air flow return passage; and a sound absorbing material arranged in said discharge air flow return passage, said sound absorbing material being attached on a surface of said flat plate portion of said diffuser on a guide vane side.

8. The electric blower according to claim 7, wherein said end bracket means has at least one through hole for allowing the discharging air flow to pass to cool said electric motor, and wherein said sound absorbing material has a surface inclined in a direction toward said at least one through-hole.

* * * * *